US008636060B2

(12) United States Patent
Hernandez

(10) Patent No.: US 8,636,060 B2
(45) Date of Patent: Jan. 28, 2014

(54) MONITORING DOWNHOLE CONDITIONS WITH DRILL STRING DISTRIBUTED MEASUREMENT SYSTEM

(75) Inventor: Maximo Hernandez, Houston, TX (US)

(73) Assignee: Intelliserv, LLC, Houston, TX (US)

( * ) Notice: Subject to any disclaimer, the term of this patent is extended or adjusted under 35 U.S.C. 154(b) by 75 days.

(21) Appl. No.: 12/396,347

(22) Filed: Mar. 2, 2009

(65) Prior Publication Data

US 2009/0166031 A1 Jul. 2, 2009

Related U.S. Application Data

(63) Continuation-in-part of application No. 11/627,156, filed on Jan. 25, 2007, now abandoned.

(60) Provisional application No. 61/033,249, filed on Mar. 3, 2008.

(51) Int. Cl.
*E21B 47/06* (2012.01)

(52) U.S. Cl.
USPC ..... 166/250.01; 175/40; 175/50; 73/152.03

(58) Field of Classification Search
USPC ..... 175/40, 50; 166/250.01; 702/6, 9; 73/152.03
See application file for complete search history.

(56) References Cited

U.S. PATENT DOCUMENTS 4,297,880 A 11/1981 Berger
4,606,415 A 8/1986 Gray, Jr. et al.
5,184,508 A 2/1993 Desbrandes
5,469,736 A 11/1995 Moake
5,887,657 A 3/1999 Bussear et al.
5,934,371 A 8/1999 Bussear et al.
5,959,547 A 9/1999 Tubel et al.
6,252,518 B1 6/2001 Laborde
6,374,913 B1 4/2002 Robbins et al.
6,415,231 B1 7/2002 Hebert
6,415,877 B1 7/2002 Fincher et al.
6,615,933 B1 9/2003 Eddison
6,648,081 B2 11/2003 Fincher et al.
6,648,082 B2 11/2003 Schultz et al.
6,659,197 B2 12/2003 Cooper
6,670,880 B1 12/2003 Hall et al.
6,712,160 B1 3/2004 Schultz et al.
6,717,501 B2 4/2004 Hall et al.
6,722,450 B2 4/2004 Schultz et al.
6,725,162 B2 4/2004 Edwards et al.
6,732,052 B2 5/2004 MacDonald et al.
6,821,147 B1 11/2004 Hall et al.
6,830,467 B2 12/2004 Hall et al.
6,844,498 B2 1/2005 Hall et al.
6,854,532 B2 2/2005 Fincher et al.

(Continued)

OTHER PUBLICATIONS

Sperry Drilling Services, "PWD (Pressure While Drilling) Sensor", Aug. 2007.

(Continued)

*Primary Examiner* — Nicole Coy
(74) *Attorney, Agent, or Firm* — Conley Rose, P.C.

(57) ABSTRACT

A method of monitoring downhole conditions in a borehole includes receiving sensor data through a network of nodes provided at selected positions on a drill string disposed in the borehole. An inference is made about the downhole condition from the sensor data. A determination is made whether the downhole condition matches a target downhole condition within a set tolerance. At least one parameter affecting the downhole condition is selectively adjusted if the downhole condition does not match the target downhole condition within the set tolerance.

14 Claims, 11 Drawing Sheets

(56) References Cited

U.S. PATENT DOCUMENTS

| | | | |
|---|---|---|---|
| 6,868,920 | B2 | 3/2005 | Hoteit et al. |
| 6,888,473 | B1 | 5/2005 | Hall et al. |
| 6,988,282 | B2 | 1/2006 | Barnett et al. |
| 7,044,237 | B2 | 5/2006 | Leuchtenberg |
| 7,062,959 | B2 | 6/2006 | Kurkjian et al. |
| 7,082,821 | B2 | 8/2006 | Chen et al. |
| 7,139,218 | B2 | 11/2006 | Hall et al. |
| 7,174,975 | B2 | 2/2007 | Krueger et al. |
| 7,201,221 | B2 | 4/2007 | Tubel et al. |
| 7,207,396 | B2 | 4/2007 | Hall et al. |
| 7,270,185 | B2 | 9/2007 | Fontana et al. |
| 7,284,903 | B2 | 10/2007 | Hartog |
| 7,311,142 | B2 | 12/2007 | Fisseler et al. |
| 7,428,924 | B2 | 9/2008 | Patel |
| 2004/0039466 | A1 | 2/2004 | Lilly et al. |
| 2004/0104797 | A1 | 6/2004 | Hall et al. |
| 2004/0113808 | A1 | 6/2004 | Hall et al. |
| 2004/0145492 | A1 | 7/2004 | Hall et al. |
| 2004/0150532 | A1 | 8/2004 | Hall et al. |
| 2005/0001735 | A1 | 1/2005 | Hall et al. |
| 2005/0092488 | A1 | 5/2005 | Rodet et al. |
| 2005/0092499 | A1 | 5/2005 | Hall et al. |
| 2005/0161215 | A1 | 7/2005 | Hall et al. |
| 2005/0173128 | A1 | 8/2005 | Hall et al. |
| 2005/0194182 | A1 | 9/2005 | Rodney et al. |
| 2005/0194184 | A1 | 9/2005 | Gleitman |
| 2005/0200498 | A1 | 9/2005 | Gleitman |
| 2005/0284663 | A1 | 12/2005 | Hall et al. |
| 2006/0085402 | A1 | 4/2006 | Brown et al. |
| 2006/0157282 | A1 | 7/2006 | Tilton et al. |
| 2007/0017671 | A1 | 1/2007 | Clark et al. |
| 2007/0029112 | A1 | 2/2007 | Li et al. |
| 2007/0030167 | A1 | 2/2007 | Li et al. |
| 2007/0045006 | A1 | 3/2007 | Krueger et al. |
| 2007/0188344 | A1 | 8/2007 | Hache et al. |
| 2007/0263488 | A1 | 11/2007 | Clark |
| 2007/0272033 | A9 | 11/2007 | Jones |
| 2008/0041576 | A1 | 2/2008 | Patel et al. |
| 2008/0135291 | A1 | 6/2008 | Hall et al. |

OTHER PUBLICATIONS

"Petrobras Emerging Well Technologies," by Ribeiro, Lage, Nogueria. Vanni and da Silva Jr.,Oil & Gas Review, 2007 OTC Edition.

IADE/SPE 112636; High Speed Telemetry Drill Pipe Network Optimizes Drilling Dynamics and Wellbore Operations, Olberg, Laastad et al 2008.

IADE/SPE 112702, The Utilization of the Massive Amount of Real-Time Data Acquired in Wired Drillpipe Operations, Olberg, Laastad et al 2008.

IADE/SPE 115206, Evolution of Innovative Test Methodology for Evaluation of Hardfacing . . . Chan, Hannahs, Waters, 2008.

IADE/SPE 112740 Evolution of Drilling Programs and Complex Wolf Profiles Drive Development . . . Chan, Hannahs, Jellison el el 2008.

60 = DIFFERENCE BETWEEN PASS 1&2
62 = DIFFERENCE BETWEEN PASS 2&3

Depth
12
(3)
$P_iP_o$
40
(2)
$P_iP_o$
40
(1)
$P_iP_o$
40
16

Depth
(3)$P_o$
(3)$P_i$
(2)$P_o$
(2)$P_i$
(1)$P_o$
(1)$P_i$
$P_{HS}$
$BHP_d$
0
Pressure Depth
(3)$P_o \approx P_i$
(2)$P_o \approx P_i$
(1)$P_o \approx P_i$
$BHP \approx P_{HS}$
0
Pressure

MONITORING DOWNHOLE CONDITIONS WITH DRILL STRING DISTRIBUTED MEASUREMENT SYSTEM

CROSS-REFERENCE TO RELATED APPLICATIONS

This application is a continuation-in-part of patent application Ser. No. 11/627,156, filed Jan. 25, 2007, the entire disclosure of which is incorporated herein by reference. This application claims the benefit of U.S. Provisional Patent Application No. 61/033,249, filed Mar. 3, 2008, the entire disclosure of which is incorporated herein by reference.

FIELD

This invention pertains generally to drilling operations and, more particularly, to distributed subsurface measurement techniques.

BACKGROUND

Drilling operators logically need as much information as possible about borehole and formation characteristics while drilling a well for safety and reserves calculations. If problems arise while drilling, minor interruptions may be expensive to overcome and, in some cases, pose a safety risk. Since current economic conditions provide little margin for error and cost, drilling operators have a strong incentive to fully understand downhole characteristics and avoid interruptions.

Gathering information from downhole can be challenging, particularly since the downhole environment is harsh, ever changing, and any downhole sensing system is subject to high temperature, shock, and vibration. In many wells, the depth of the well at which the sensors or transmission systems are positioned causes significant attenuation in the signals which are transmitted to the surface. If signals are lost or data becomes corrupted during transmission, the operator's reliance on that data may result in significant problems. Accordingly, many downhole conditions sensed while drilling a well have reliability concerns.

Typically, various types of sensors may be placed at a selected location along the bottom end of the drill string, and a mud pulser or other transmitter (e.g., electromagnetic), which are part of a measurement-while-drilling (MWD) system, is widely used in the oilfield industry to transmit and send signals to the surface. Signals from bottom hole sensors may be transmitted to the surface from various depths, but sensed conditions at a particular depth near the wellbore are generally assumed to remain substantially the same as when initially sensed. In many applications, this assumption is erroneous, and downhole sensed conditions at a selected depth change over time. In other applications, a downhole condition may not have changed, but the error rate in the transmitted signals does not provide high reliability that the sensed conditions are accurately determined. Updated sensed conditions are typically not available to the drilling operator, and accordingly most drilling operations unnecessarily incur higher risks and costs than necessary. For clarity, as formation changes rarely occur when drilling, the mud flow path is in constant change containing flow and transporting heterogeneous loads of formation cuttings.

A need remains for improved techniques to identify, measure, analyze, and adjust downhole conditions during drilling operations.

SUMMARY

Aspects of the invention include a method of monitoring downhole conditions in a borehole penetrating a subsurface formation. The method comprises disposing a string of connected tubulars in a borehole, where the string of tubulars forms a downhole electromagnetic network that provides an electromagnetic signal path. The method includes receiving sensor data through the downhole electromagnetic network and making an inference about a downhole condition from the sensor data. The method further includes selectively adjusting at least one parameter affecting the downhole condition based on the inference.

(a) Selectively adjusting the at least one parameter comprises selectively adjusting the at least one parameter until the downhole condition matches a target downhole condition within a set tolerance.

(b) Selectively adjusting the at least one parameter comprises selectively commanding at least one downhole device through the downhole electromagnetic network to adjust the at least one parameter.

(c) Selectively adjusting the at least one parameter comprises selectively adjusting the at least one parameter from outside of the borehole.

(d) Receiving sensor data comprises receiving sensor data from one or more first sensors configured to measure downhole conditions that are likely to change substantially over time.

(d.1) Receiving sensor data further comprises receiving sensor data from one or more second sensors configured to measure the depth of the string of connected tubulars in the borehole as the downhole conditions are measured.

(d.1.1) Making an inference about the downhole condition comprises correlating the portion of the sensor data from the one or more first sensors to the portion of the sensor data from the one or more second sensors.

(e) Receiving sensor data comprises receiving sensor data from one or more pressure sensors disposed at different positions along the string of connected tubulars. Other aspects of the invention can be implemented with other types of sensors (e.g., temperature, vibration, torque, weight on bit, caliper, gravity, etc.) or a combination of sensors distributed along the string. Any suitable sensor as known in the art may be used to implement aspects of the invention.

(e.1) Making an inference about the downhole condition comprises generating a pressure gradient curve using the sensor data.

(e.1.1) Selectively adjusting the at least one parameter comprises adjusting the at least one parameter if the pressure gradient curve does not match a target downhole condition within a set tolerance.

(e.1.1.1) Selectively adjusting the at least one parameter comprises adjusting the pressure distribution along the borehole to alter the apparent equivalent circulating density.

(e.1.1.2) Selectively adjusting the at least one parameter comprises one of (i) activating and controlling one or more variable flow restrictors to restrict flow in an annulus between the borehole and the string of tubulars if the pressure at the bottom of the borehole is smaller than a target bottom pressure and (ii) activating and controlling one or more variable flow restrictors to restrict flow inside a bore of the string of tubulars if the pressure at the bottom of the borehole is greater than a target bottom pressure.

(f) Receiving sensor data comprises receiving sensor data from one or more third sensors configured to measure downhole conditions that are not likely to change substantially over time.

(g) Receiving sensor data comprises receiving information about changes in the downhole condition at a selected depth in the borehole over time.

(h) Receiving sensor data comprises receiving sensor data collected by a first sensor at a first position on the string of tubulars when the first sensor is at a first selected depth in the borehole and sensor data collected by a second sensor at a second position on the string of tubulars when the second sensor is at the first selected depth, the first position being axially spaced apart from the second position along the string of tubulars.

(i) Receiving sensor data comprises receiving sensor data collected.

(j) Sensor data collected by the first sensor and second sensor relate to a caliper profile of the borehole at the first selected depth.

(k) Receiving sensor data occurs at selected time intervals.

(l) Receiving sensor data is preceded by sending one or more commands to one or more sensors through the downhole electromagnetic network to measure one or more downhole conditions.

(m) The downhole condition is dynamic stability of the string of tubulars.

(m.1) Selectively adjusting the at least one parameter comprises actuating a counter-weight device to counteract selected harmonics on the string of tubulars.

(m.2) The at least one parameter is an input parameter to the string of tubulars selected from the group consisting of flow rate, weight on bit, and rotational speed.

BRIEF DESCRIPTION OF DRAWINGS

Other aspects and advantages of the invention will become apparent upon reading the following detailed description and upon reference to the drawings in which like elements have been given like numerals and wherein.

DETAILED DESCRIPTION

Figure 1:
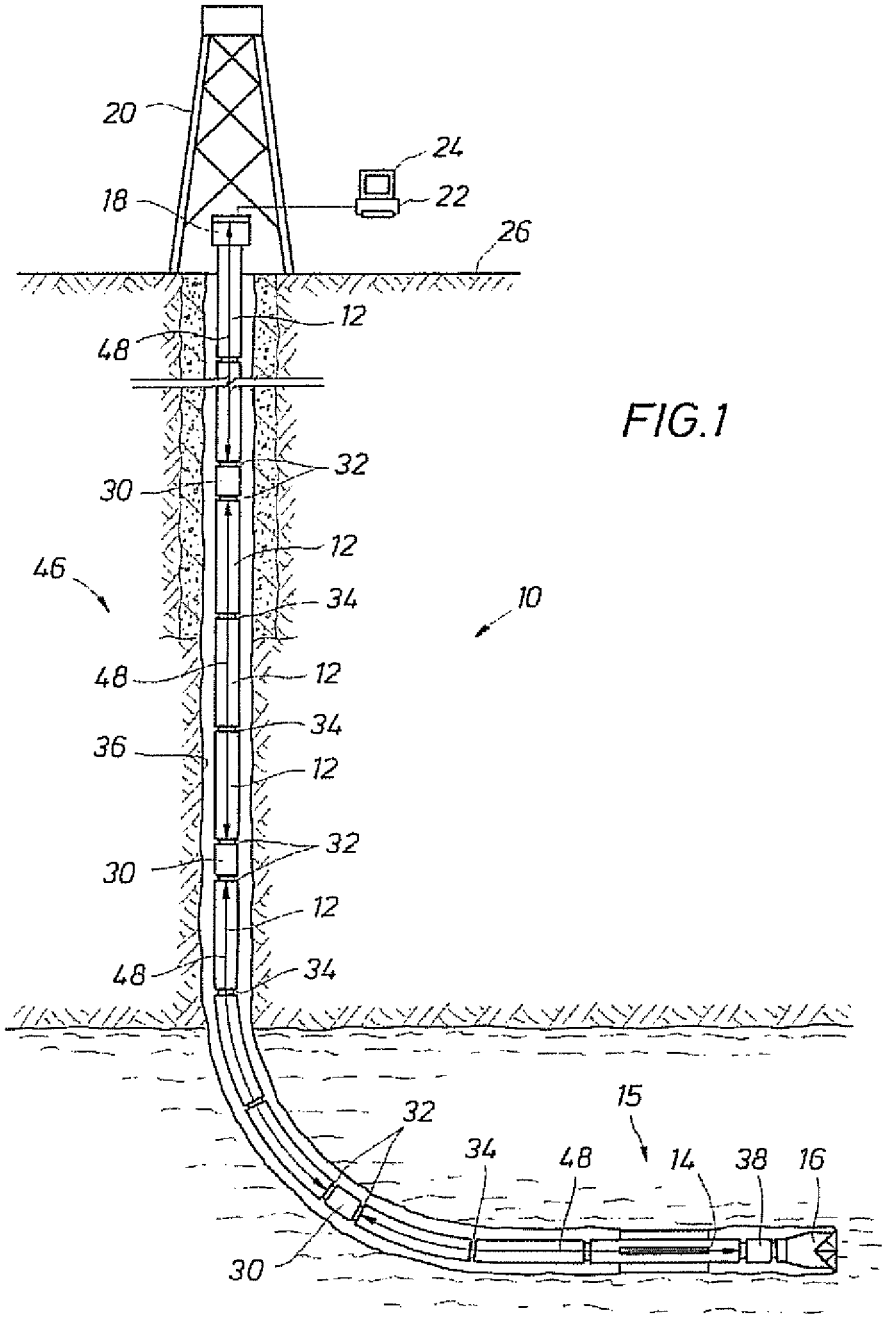
FIG. 1 is a schematic of a drill rig showing a directional drilling application and a system for sensing borehole or formation characteristics in accordance with aspects of the invention.

FIG. 1 illustrates a drilling operation 10 in which a borehole 36 is being drilled through subsurface formation beneath the surface 26. The drilling operation includes a drilling rig 20 and a drill string 12 of coupled tubulars which extends from the rig 20 into the borehole 36. A bottom hole assembly (BHA) 15 is provided at the lower end of the drill string 12. The bottom hole assembly (BHA) 15 may include a drill bit or other cutting device 16, a bit sensor package 38, and a directional drilling motor or rotary steerable device 14, as shown in FIG. 1.

The drill string 12 preferably includes a plurality of network nodes 30. The nodes 30 are provided at desired intervals along the drill string. Network nodes essentially function as signal repeaters to regenerate data signals and mitigate signal attenuation as data is transmitted up and down the drill string. The nodes 30 may be integrated into an existing section of drill pipe or a downhole tool along the drill string. Sensor package 38 in the BHA 15 may also include a network node (not shown separately). For purposes of this disclosure, the term "sensors" is understood to comprise sources (to emit/transmit energy/signals), receivers (to receive/detect energy/signals), and transducers (to operate as either source/receiver). Connectors 34 represent drill pipe joint connectors, while the connectors 32 connect a node 30 to an upper and lower drill pipe joint.

The nodes 30 comprise a portion of a downhole electromagnetic network 46 that provides an electromagnetic signal path that is used to transmit information along the drill string 12. The downhole network 46 may thus include multiple nodes 30 based along the drill string 12. Communication links 48 may be used to connect the nodes 30 to one another, and may comprise cables or other transmission media integrated directly into sections of the drill string 12. The cable may be routed through the central borehole of the drill string 12, or routed externally to the drill string 12, or mounted within a groove, slot or passageway in the drill string 12. Preferably signals from the plurality of sensors in the sensor package 38 and elsewhere along the drill string 12 are transmitted to the surface 26 through a wire conductor 48 along the drill string 12. Communication links between the nodes 30 may also use wireless connections.

A plurality of packets may be used to transmit information along the nodes 30. Packets may be used to carry data from tools or sensors located downhole to an uphole node 30, or may carry information or data necessary to operate the network 46. Other packets may be used to send control signals from the top node 30 to tools or sensors located at various downhole positions. 96 Further detail with respect to suitable nodes, a network, and data packets are disclosed in U.S. Pat. No. 7,207,396 (Hall et al., 2007), hereby incorporated in its entirety by reference.

Figure 2:
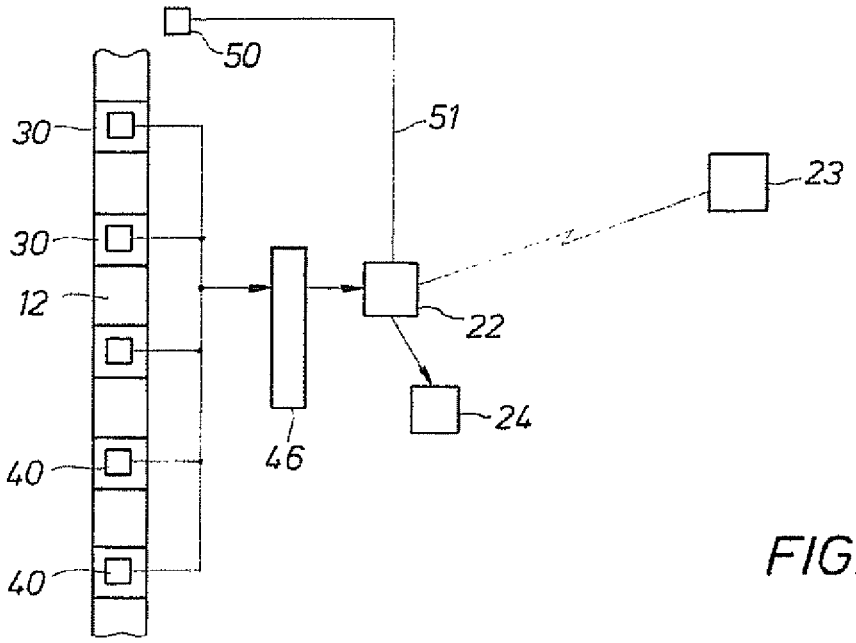
FIG. 2 is a functional block diagram of a data transmission scheme from a plurality of sensors in accordance with aspects of the invention.

Referring to FIG. 2, various types of sensors 40 may be employed along the drill string 12 in aspects of the present invention, including without limitation, axially spaced resistivity, caliper, acoustic, rock strength (sonic), pressure sensors, temperature sensors, seismic devices, strain gauges, inclinometers, magnetometers, accelerometers, bending, vibration, neutron, gamma, gravimeters, rotation sensors, flow rate sensors, etc. Sensors which measure conditions which would logically experience significant change over time provide particularly valuable information to the drilling operator. For example, the caliper or cross-sectional configuration of a wellbore at a particular depth may change during the drilling operation due to formation stability and fluid washout conditions. The skin of a formation defining the borehole may tend to absorb fluids in the well and may thus also change over time, particularly if the well is overbalanced. By providing a system which allows a sensor to transmit to the surface at a known depth in substantially real time, a particular borehole or formation characteristic, such as the caliper of the well, and by providing another sensor which can provide the same type of information at substantially the same depth with a different sensor as the well is drilled deeper, the operator is able to compare a wellbore caliper profile at a selected depth at time one, and later measure the same caliper at substantially the same depth at time two. This allows the operator to better understand changes in the well that occur over time, and to take action which will mitigate undesirable changes. Other sensors which monitor conditions which are likely to degrade or change over time include sensors that measure wellbore stability, resistivity sensors, equivalent circulating density (ECD) measurements sensors, primary and/or secondary porosity sensors, nuclear-type sensors, temperature sensors, etc.

Other sensors may monitor conditions which are unlikely to substantially change over time, such as borehole inclination, pore pressure sensors, and other sensors measuring petrophysical properties of the formation or of the fluid in the formation. In the latter case, an operator may use the signals from different sensors at different times to make a better determination of the actual condition sensed. For example, the inclination of a wellbore at a particular depth likely will not change. The inclination measurement at time one may thus be averaged with an inclination at the same depth at time two and another inclination measurement at the same depth at time three, so that the average of these three signals at the same depth taken at three times will likely provide a more accurate indication of the actual borehole inclination, or interpretation of an incremental change at a particular depth.

According to an aspect of the invention, an operator at the surface may instruct a particular sensor to take a selected measurement. In most applications, however, a plurality of substantially identical sensors for sensing a particular drill string, wellbore, or formation characteristic will be provided along the drill string, and each of those sensors will output a signal at a selected time interval, e.g., every tenth of a second or every second, such that signals at any depth may be correlated with signals from a similar sensor at another depth. Thus an entire profile of the sensed condition based on a first sensor as a function of depth may be plotted by the computer, and a time lapse plot may be depicted for measurements from a second sensor while at the same depth at a later time. Also, it should be understood that the system may utilize sensors which are able to take reliable readings while the drill string and thus the sensors are rotating in the well, but in another application the rotation of the drill string may be briefly interrupted so that sensed conditions can be obtained from stationary sensors, then drilling resumed. In still other aspects, the drill string may slide or rotate slowly in the well while the sensed conditions are monitored, with the majority of the power to the bit being provided by the downhole motor or rotary steerable device.

A significant advantage of the present invention is the ability to analyze information from the sensors when there is time lapse effect between a particular sensed condition at a particular depth, and the subsequent same sensed condition at the same depth. As disclosed herein, the system provides sensors for sensing characteristics at a selected depth in a well, and a particular depth may be "selected" in that the operator is particularly concerned with signals at that depth, and particularly change and rate of change for certain characteristics. Such change and rate of change (time lapse in the transmitted signals) may be displayed to the operator in real time. Otherwise stated, however, information from a sensor at selected axial locations or after a selected time lapse may be important, and the term "selected" as used herein would include a signal at any known, presumed, or selected depth.

FIG. 2 illustrates conceptually a drill pipe 12 having a plurality of axially spaced sensors 40 spaced along the drill string, each for sensing the same borehole or formation characteristic. Multiple and varied sensors 40 may be distributed along the drill pipe 12 to sense various different characteristics/parameters. The sensors 40 may be disposed on the nodes 30 positioned along the drill string, disposed on tools incorporated into the string of drill pipe, or a combination thereof. The sensors 40 may be disposed along the string using any desired combination of sensor types (e.g., acoustic, pressure, temperature, etc.) and at any desired spacing between the sensors or intervals along the string. The downhole network 46 transmits information from each of a plurality of sensors 40 to a surface computer 22, which also receives information from a depth sensor 50 via line 51. Depth sensor 50 monitors the length of drill string inserted in the well, and thus the output from the sensors 40 may be correlated by the computer 22 as a function of their depth in the well.

Information from the well site computer 22 may be displayed for the drilling operator on a well site screen 24. Information may also be transmitted from computer 22 to another computer 23, located at a site remote from the well, with this computer 23 allowing an individual in the office remote from the well to review the data output by the sensors 40. Although only a few sensors 40 are shown in the figures, those skilled in the art will understand that a larger number of sensors may be disposed along a drill string when drilling a fairly deep well, and that all sensors associated with any particular node may be housed within or annexed to the node 30, so that a variety of sensors rather than a single sensor will be associated with that particular node.

Figure 3:
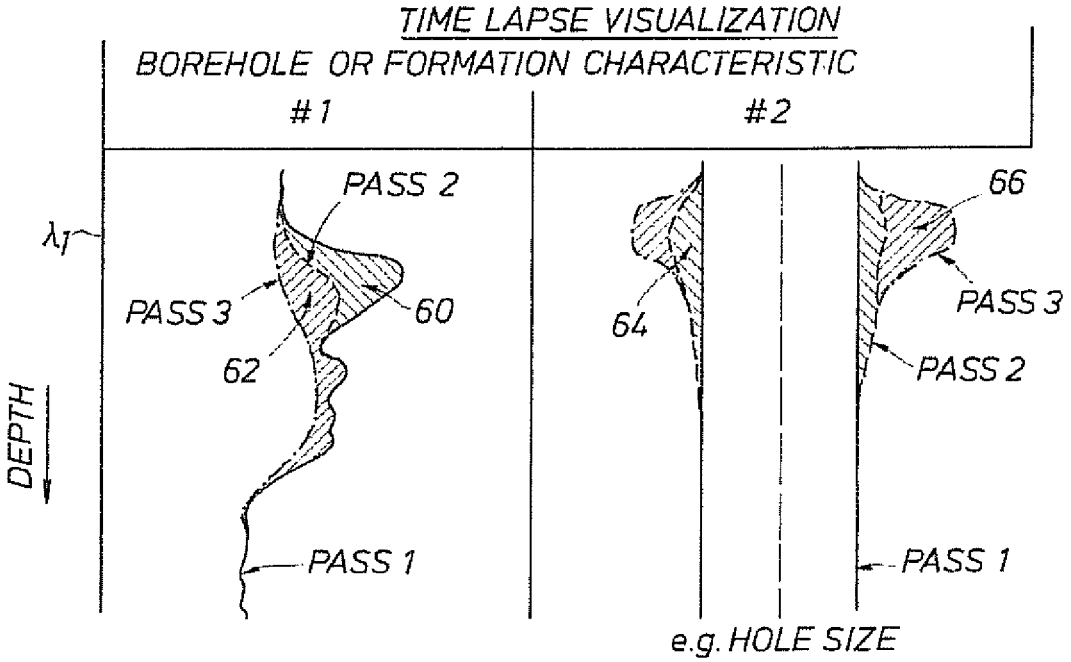
FIG. 3 is a representative plot for analyzing measurements at the same depths for changes over time in accordance with aspects of the invention.

FIG. 3 depicts a plot of sensed borehole information characteristics numbered 1 and 2 each plotted as a function of depth, and also plotted as a function of time when the measurements are taken. For characteristic #1, pass 1 occurs first, pass 2 occurs later, and pass 3 occurs after pass 2. The area represented by 60 shows the difference in measurements between passes 1 and 2, while the area represented by 62 represents a difference in measurements between passes 2 and 3. The strong signal at depth D1 for the first pass is thus new and is further reduced for pass 2 and pass 3. For characteristic #2, the area 64 represents the difference between the pass 1 signal and the pass 2 signal, and the area 66 represents the difference between the pass 2 and pass 3 signals. For this borehole information characteristic, signal strength increases between pass 1 and 2, and further increases between pass 2 and 3.

Those skilled in the art will appreciate that various forms of markings may be employed to differentiate a first pass from a second pass, and a second pass from a subsequent pass, and that viewing the area difference under the curve of signals from different passes is only one way of determining the desired characteristic of the borehole or formation. Assuming that characteristic #2 is the borehole size, the operator may thus assume that, at a depth shortly above depth D1, the borehole has increased in size, and has again increased in size between the taking of the pass 2 measurements and the pass 3 measurements. For all of the displayed signals, signals may be displayed as a function of plurality of sensors at a single elected location in a borehole, so that a sent signal at a depth of, e.g., 1550 feet, will be compared with a similar signal from a similar sensor subsequently at a depth of 1550 feet.

Aspects of the invention also include the identification of drill string 12 dynamics and stabilization of force distributions along the string during drilling operations. The sensors 40 along the string 12 and/or on the nodes 30 are used to acquire drilling information, to process the data, and instigate reactions by affecting the mechanical state of the drilling system, affecting fluid flow through the drill pipes, fluid flow along the annulus between the string and the borehole 36, and/or commanding another device (e.g., a node) to perform an operation.

The telemetry network 46 (as described in U.S. Pat. No. 7,207,396, assigned to the present assignee and entirely incorporated herein by reference) provides the communication backbone for aspects of the invention. A number of drill string dynamic measurements can be made along the string 12 using the sensor 40 inputs as disclosed herein. In some aspects of the invention, for example, the measurements taken at the sensors 40 can be one or a group of tri-axial inclinometry (magnetic and acceleration), internal, external hydraulic pressure, torque and tension/compression. With such measurements, various analysis and adjustment techniques can be implemented independently or as part of a self-stabilizing string.

Aspects comprising acoustic sensors 40 may be used to perform real-time frequency, amplitude, and propagation speed analysis to determine subsurface properties of interest such as wellbore caliper, compressional wave speed, shear wave speed, borehole modes, and formation slowness. Improved subsurface acoustic images may also be obtained to depict borehole wall conditions and other geological features away from the borehole. These acoustic measurements have applications in petrophysics, well to well correlation, porosity determination, determination of mechanical or elastic rock parameters to give an indication of lithology, detection of over-pressured formation zones, and the conversion of seismic time traces to depth traces based on the measured speed of sound in the formation. Aspects of the invention may be implemented using conventional acoustic sources disposed on the nodes 30 and/or on tools along the string 12, with appropriate circuitry and components as known in the art. Real-time communication with the acoustic sensors 40 is implemented via the network 46.

Figures 4A, 4B, 4C:
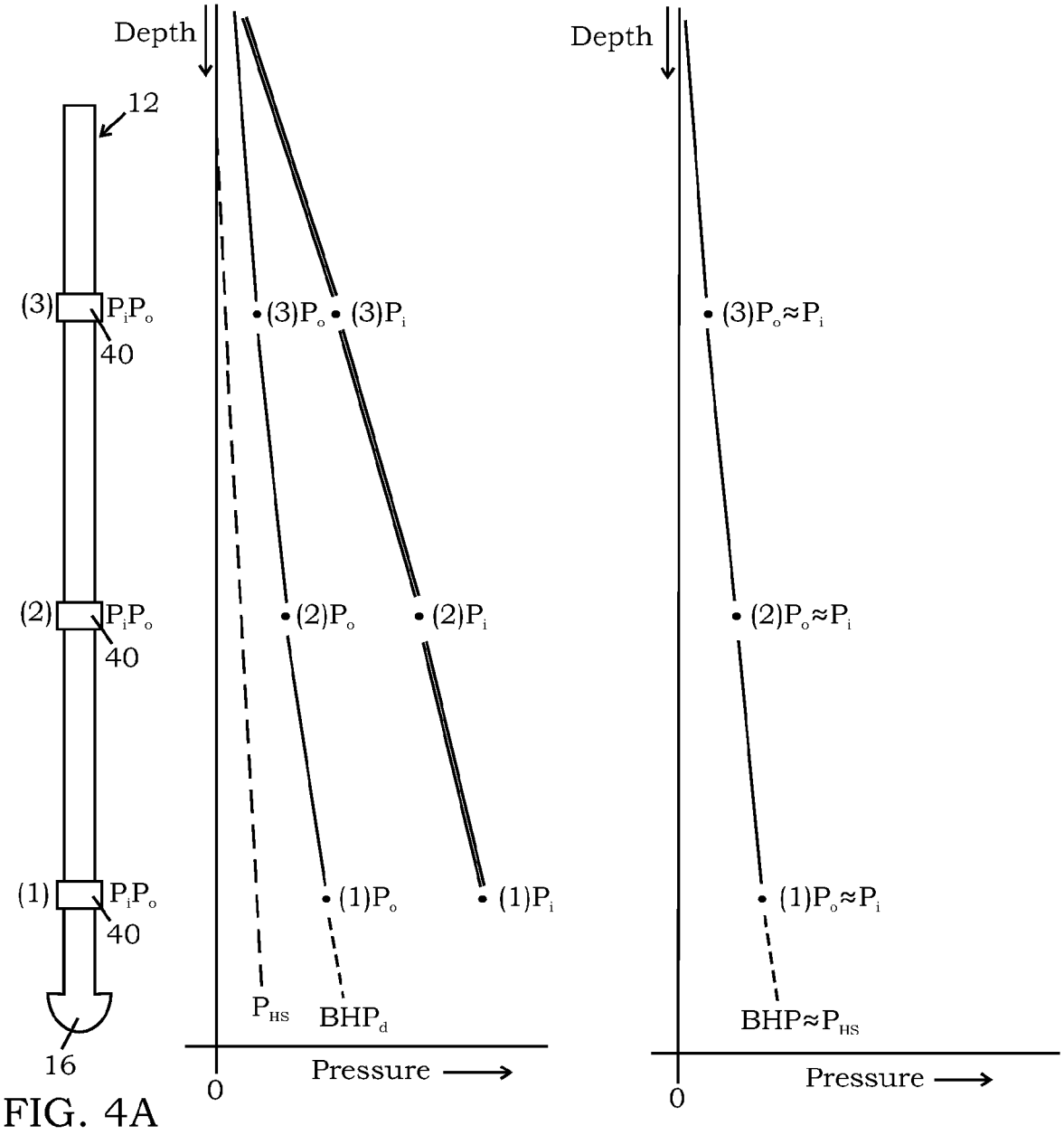
FIG. 4A is a schematic of a drilling system with aspects of the invention.
FIG. 4B is a downhole pressure plot while pumping in accordance with aspects of the invention.
FIG. 4C is a downhole pressure plot while not pumping in accordance with aspects of the invention.

One aspect of the invention provides for automated downhole control of pressure. FIG. 4A shows a drill string 12 implemented with three sensors 40 along the string to acquire internal and external pressure measurements. During drilling operations, drilling fluid ("mud") is pumped through the string 12 as known in the art and a certain pressure distribution occurs along the borehole. FIG. 4B shows Hydrostatic Pressure curve while pumping drilling fluid through the drill string 12. $BHP_d$ represents dynamic bottomhole pressure. $P_{HS}$ represents theoretical hydrostatic pressure. $P_i$ is the pressure inside the drill string 12, and $P_o$ is the pressure outside of the drill string 12. The difference between $P_i$ and $P_o$ is pressure loss or drawdown. When the drilling operations stop (e.g., to add/remove a tubular or any other reason including failures), the hydraulic system internal and external to the string 12 will stabilize to the Hydrostatic Pressure curves as shown in FIG. 4C. At that point, the drill pipe's internal pressure $P_i$ is equivalent to zero on surface since the pump connection is removed.

The states described above occur at any time in the drilling process. The continuously changing bottom hole pressure exerts a force into the formation rock at bottom and along the borehole that is dependent on the mud weight, flow rate and total flow area at the drill bit 16. This pressure interacts with the formation rocks which in certain instances can be either mechanically affected if the bottom hole pressure is beyond or below the limits of the rock's characteristic strength. These boundaries are commonly known as break-out pressure (the pressure at which a rock starts to fail and falls into the wellbore in small pieces due to the lack of support from the hydrostatic or dynamic pressure) and fracture pressure (the pressure at which a rock parts at the minimum stress direction due to over stress).

Figure 5A:
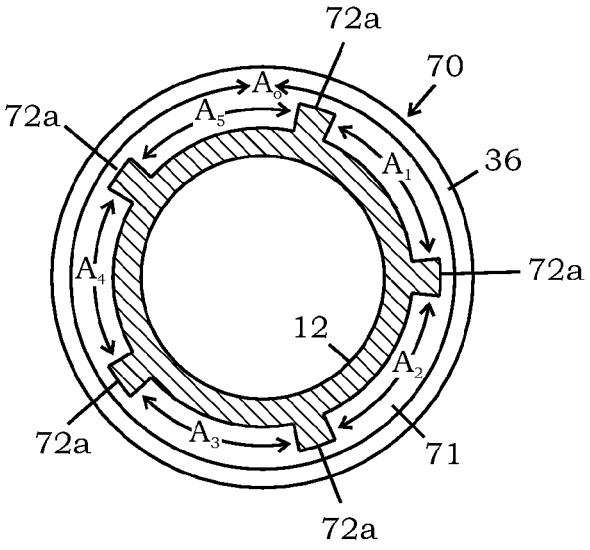
FIG. 5A is a schematic of a sub with variable stabilizer in retracted mode in accordance with aspects of the invention.
Figure 5B:
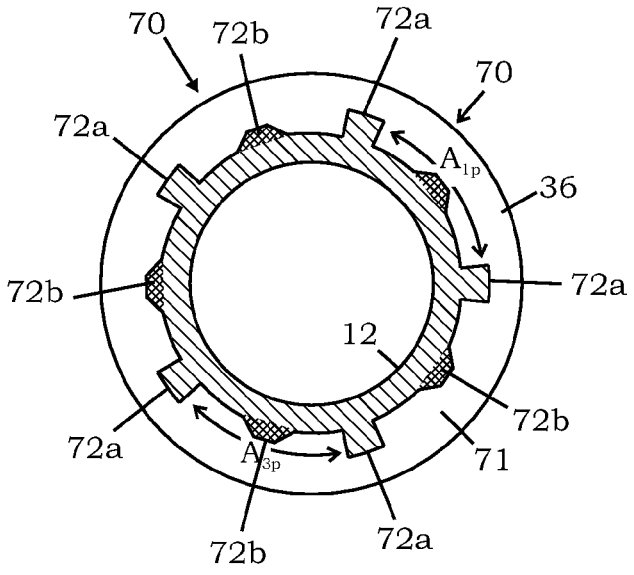
FIG. 5B is a schematic of a sub with variable stabilizer in extended mode in accordance with aspects of the invention.
Figure 5C:
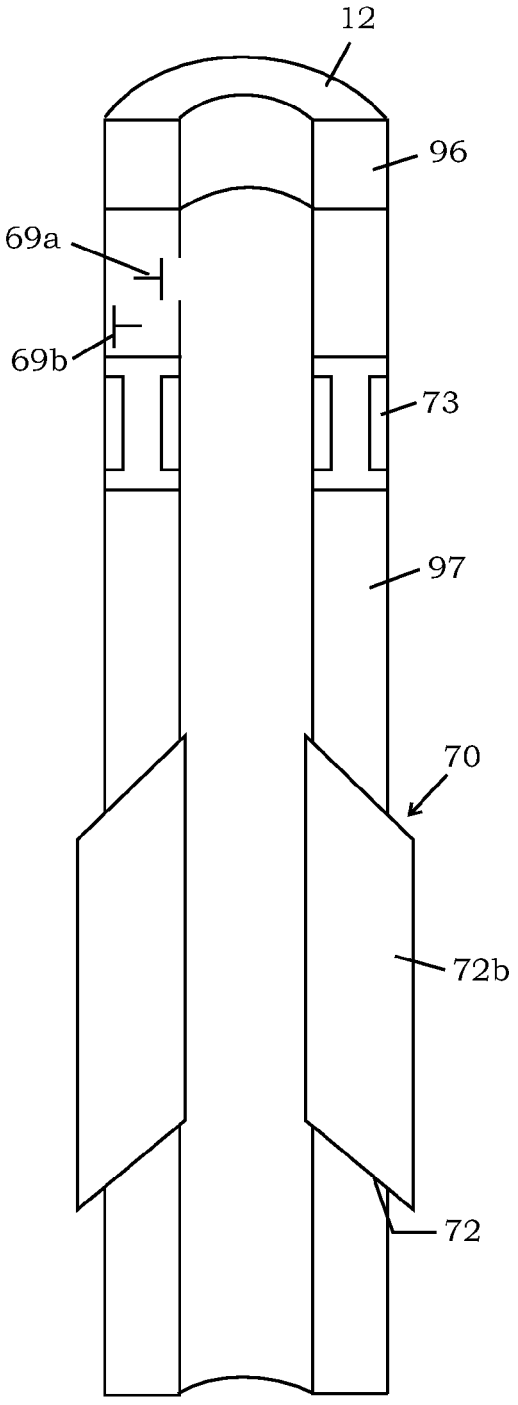
FIG. 5C is a schematic of a mechanism for actuating the variable stabilizer of FIGS. 5A and 5B in accordance with aspects of the invention.

The first case, which is caused by a smaller bottom hole pressure than required to keep the formation rock stable, is addressed by an aspect of the invention entailing a variable annular flow area controller sub (70 in FIGS. 5A-5C). The controller 70 may include fixed area restrictors and extendable area restrictors. In FIG. 5A, the controller 70 is in the retracted mode and the fixed area restrictors 72*a* are visible. In FIG. 5B, the controller 70 is in the extended mode and the extendable area restrictors 72*b* are visible along with the fixed area restrictors 72*a*. In the extended mode, the flow area in the annulus 71 between the controller 70 and the borehole 36 is restricted by extension of the area restrictors 72*b* into the annulus 71. FIG. 5C shows a mechanism for actuating the area restrictors 72*b* of the controller 70. The area restrictors 72*b* are actuated with mud flow that is diverted from the inner pipe bore 12*a* via valves 69*a*, 69*b* to a piston actuator 73 that expands or extends the area restrictors 72*b* causing a positive pressure differential across the device. The controller sub 70 comprises a pipe 12 section implemented with components known in the art (e.g., extendable blades similar to standoff ribs). As shown in FIG. 5C, the controllers 70 can be configured with a counter-acting area 72 such that upward mud flow along the annulus aids in extending the stabilizers. The pipe 12 may also be implemented with appropriate valves to vent internal pressure to the pipe exterior. Conventional electronics, components 96, and hardware may be used to implement aspects of the invention. The controller sub 70 may be implemented with pressure accumulator 97. FIG. 5A shows the controller 70 in a retracted mode, with a flow area $A_0$ comprising unrestricted areas $A_1$-$A_5$. FIG. 5B shows the controller 70 in an extended mode, with extended restrictors 72*b* reducing combined flow area ($A_0$ in FIG. 5A). For example, area $A_{1p}$ (in FIG. 5B)<$A_1$ (in FIG. 5A) and area $A_{3p}$ (in FIG. 5B)<$A_3$ (in FIG. 5A) due to the extended restrictors 72*b*. The pipe 12 may be configured with any number (e.g., 1, 2, 3, etc.) of extendable restrictors 72*b* and any number of combined fixed/extendable restrictors 72*a*, 72*b* as desired. Controller 70 embodiments of the invention can also be configured using various materials (e.g., PEEK™, rubber, composites, etc.) and in any suitable configurations (e.g., inflatable type, etc.). Aspects can also be configured with area restrictors that can be individually graduated.

Figure 6A:
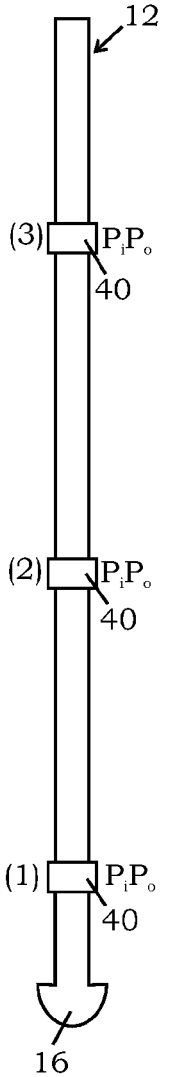
FIG. 6 is a schematic of a drilling system and downhole pressure plots in accordance with aspects of the invention.
Figure 6B:
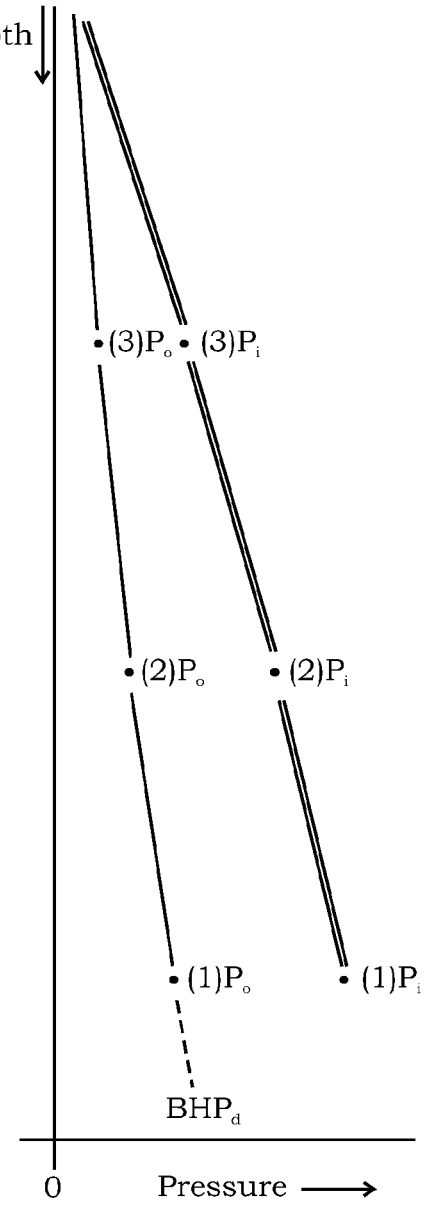
Figure 6C:
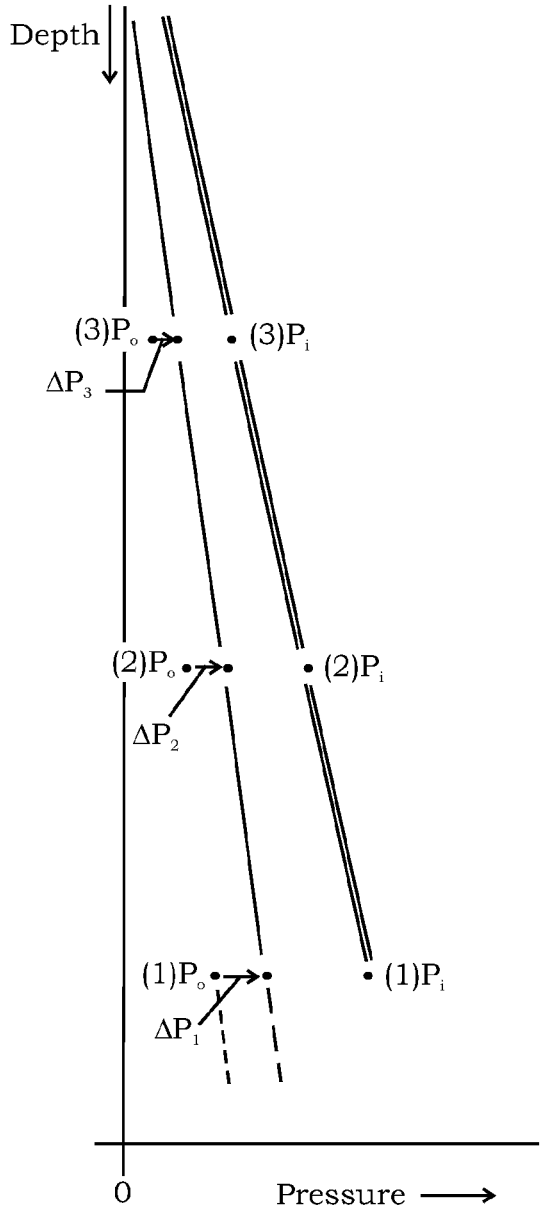

FIG. 6 depicts an aspect of the invention with the drill string 12 incorporating variable annular flow area controller subs 70. With the distributed sensors 40 and controllers 70 linked into the network 46, targeted downhole pressure conditions can be identified and the stabilizers can be selectively activated to extend their restrictor(s) along the string to reduce the mud flow along the annulus. Activation of the controller subs 70 provides a way to effectively increase/decrease the pressure along the borehole to alter the apparent equivalent circulating density (ECD) as desired. ECD is drilling fluid density that would be required to produce the same effective borehole pressure as the combination of fluid density, circulating pressure, and cuttings loading of the drilling fluid in the wellbore. Individual controller 70 actuation can be manually or automatically controlled via the communication network 46. Aspects with automatic controller 70 activation can be implemented by appropriate programming, such as by the Algorithm I, which is outlined in FIG. 7.

Figure 7:
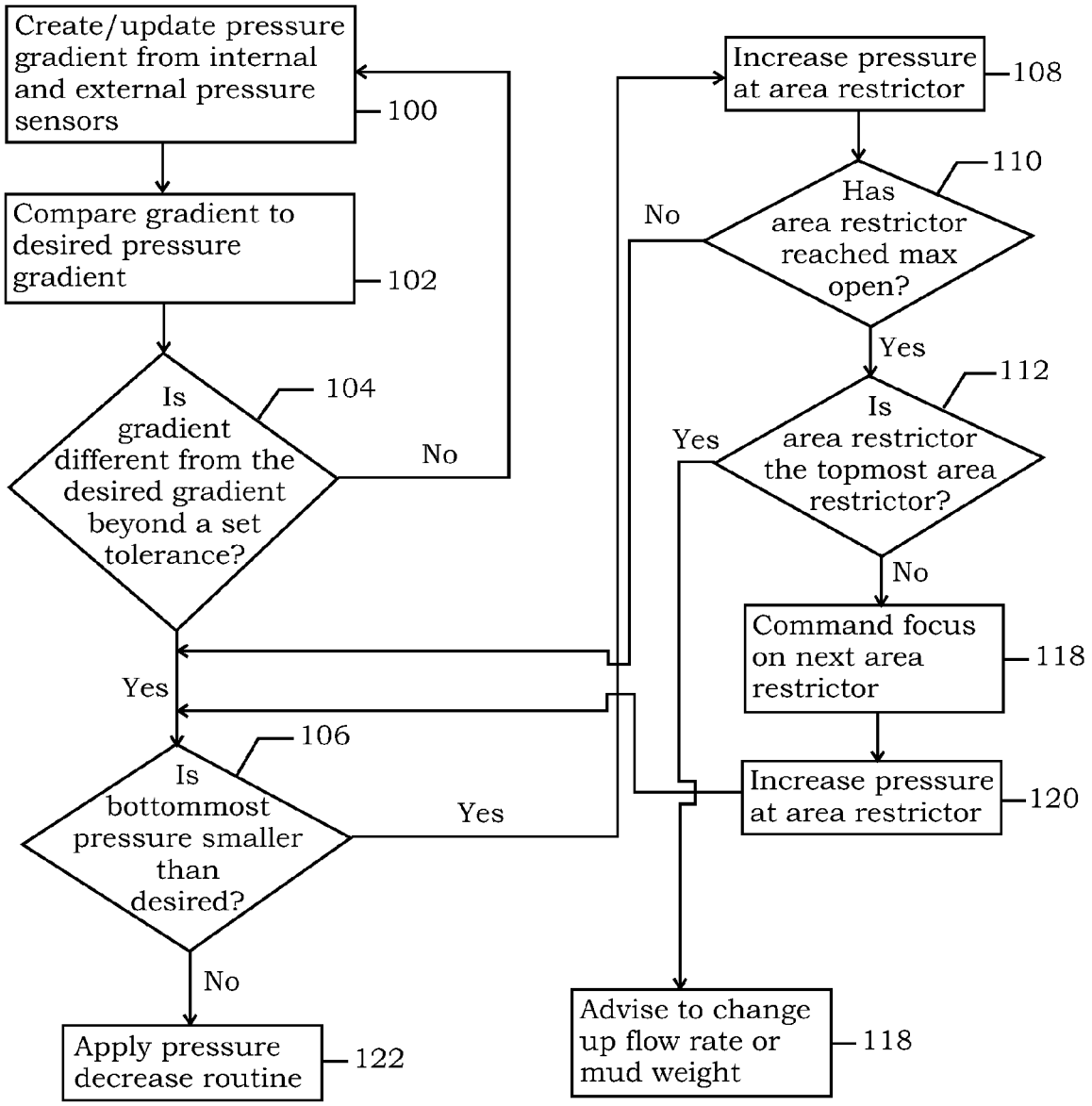
FIG. 7 is a flow chart of a downhole pressure analysis/control process in accordance with aspects of the invention.

Referring to FIG. 7, Algorithm I includes creating a pressure gradient curve from data received from internal and external pressure sensors (100). If a pressure gradient curve already exists, the existing pressure gradient curve may be updated with the new information instead of generating a fresh one. Algorithm I includes comparing the generated pressure gradient curve to a desired pressure gradient (102). Algorithm I includes checking whether the difference between the generated pressure gradient and the desired pressure gradient exceeds a set tolerance (104). If the answer to step 104 is no, steps 100 and 102 are repeated until the answer to step 104 is yes. It should be noted that steps 100 and 102 may be repeated at set times rather than continuously since it may be quite a while before the answer to step 104 is positive. If the answer to step 104 is yes, Algorithm I then checks whether the bottomhole pressure is smaller than the desired pressure (106). If the answer to step 106 is yes, Algorithm I sends a command to increase the pressure at an area restrictor (108). Algorithm I then checks whether the selected area restrictor has reached the maximum open position (110). If the answer to step 110 is no, Algorithm I returns to step 106. If the answer to step 106 is still yes, then steps 108 and 110 are repeated. For the sake of argument, if the answer to step 110 is yes, i.e., that the area restrictor that has reached maximum open position, then Algorithm I checks whether the area restrictor at the maximum open position is the topmost area restrictor (112). If the answer to step 112 is yes, Algorithm I advises the system to adjust the flow rate or mud weight (118). However, if the answer to step 110 is no, i.e., that the area restrictor that has reached maximum open position is not the topmost area restrictor, then Algorithm I sends a command to focus on the next area restrictor (118) and to increase the pressure at the area restrictor (120). Algorithm I returns to step 106 to determine whether the increase in pressure has solved the problem or if additional increase in pressure at the area restrictor is required. This process has been described above. If at step 106 the answer is no, i.e., the bottommost pressure is not smaller than the desired pressure, Algorithm I activates a pressure decrease routine (122), which is outlined in FIG. 9 and will be described below.

Figure 8A:
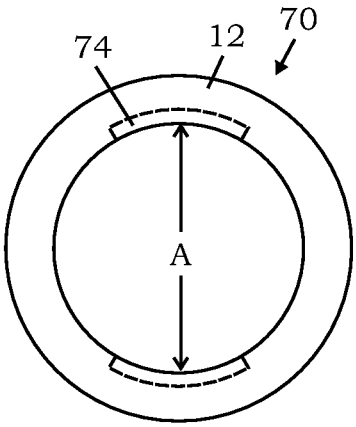
FIG. 8A is a schematic of a sub with variable restrictors in the retracted mode in accordance with aspects of the invention.
Figure 8B:
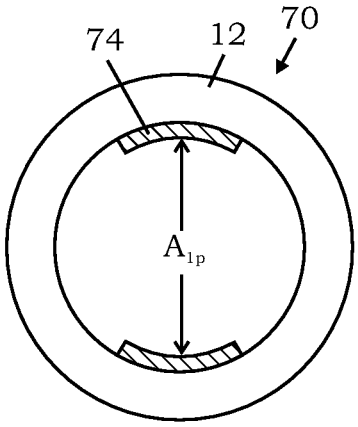
FIG. 8B is a schematic of a sub with variable restrictors in the extended mode in accordance with aspects of the invention.
Figure 8C:
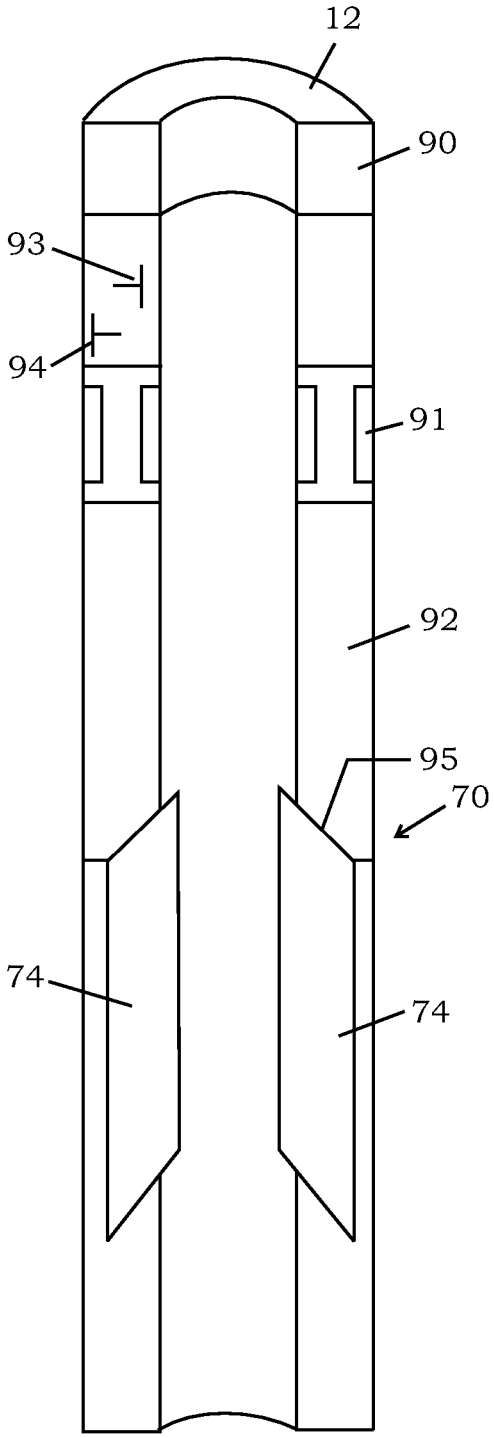
FIG. 8C is a schematic of a mechanism for actuating the variable stabilizer of FIGS. 8A and 8B in accordance with aspects of the invention.

Another case, when the bottom hole pressure is higher, is usually caused by a combination of the mud weight (density), mud flow speed and other factors. Another aspect of the invention is shown in FIGS. 8A-8C. In this aspect, an internal flow area controller sub 70 is implemented with one or more internal variable restrictors 74 controlled by electronics 90, pistons 91, pressure accumulators 92, valves 93, 94, counteracting area for downward flow 95, and additional components incorporated into the pipe similar to the aspect of FIG. 5C. FIG. 8A shows the controller sub 70 with the restrictors 74 in a retracted mode, providing an unrestricted inner pipe bore flow area A. FIG. 8(*b*) shows the restrictors 74 in an extended mode, reducing the inner bore flow area such that $A_{1p}<A$ due to the extended restrictors 74. The pipe 12 may be configured with any number (e.g., 1, 2, 3, etc.) of extendable restrictors 74 and other aspects may include a combination of fixed/extendable internal restrictors (not shown) as desired. Aspects can also be configured with restrictors 74 that can be individually graduated. Activation of the restrictor(s) 74 may be controlled manually or automatically via the network 46. Aspects with automatic controller 70 activation can be implemented by appropriate programming, such as by the Algorithm II outlined in FIG. 9. Activation of the restrictors 74 provides a way to increase/decrease the flow through the pipe 12, thereby increasing/reducing the bottom hole pressure as desired.

Figure 9:
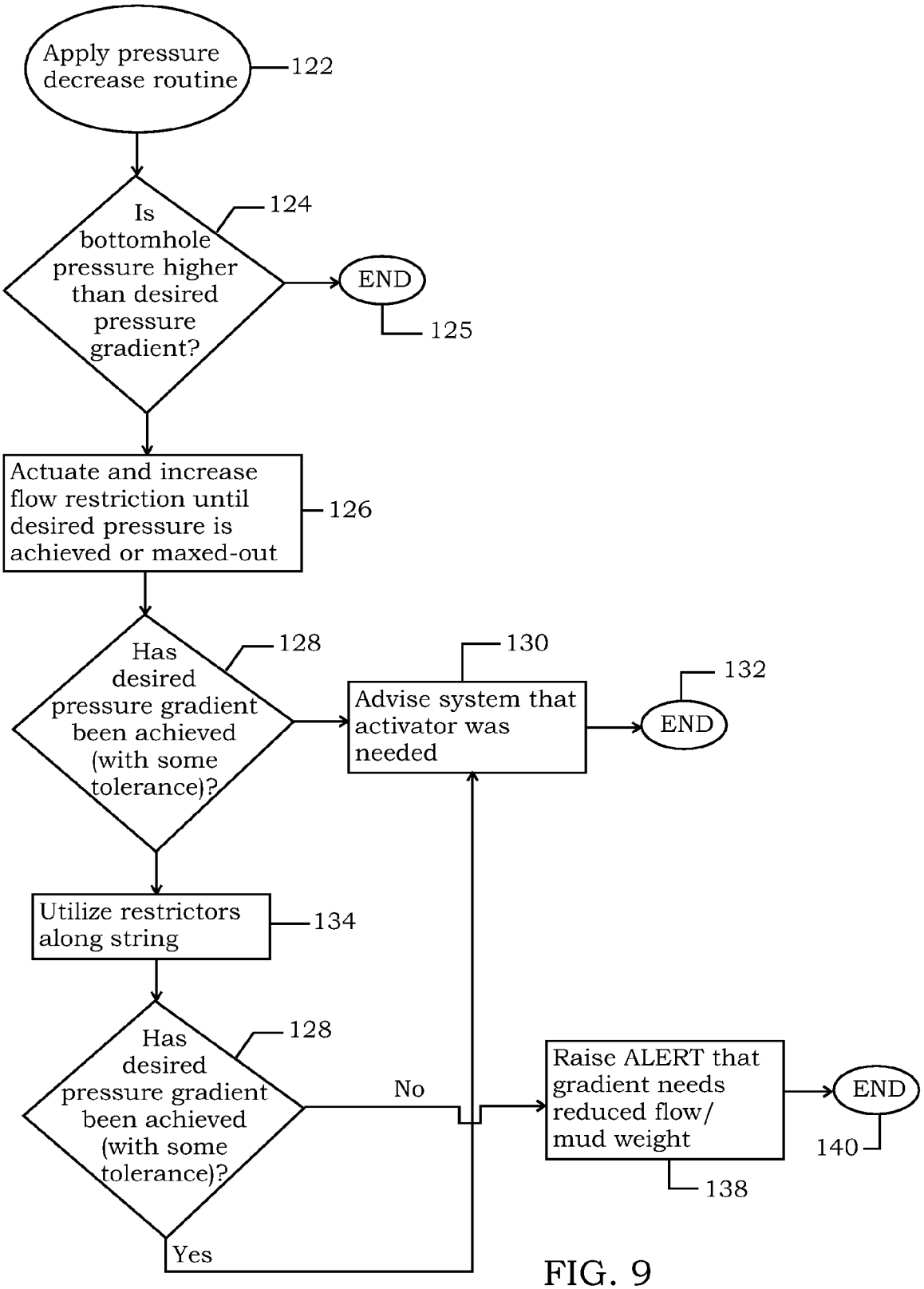
FIG. 9 is a flow chart of a downhole pressure analysis/control process in accordance with aspects of the invention.

Referring to FIG. 9, Algorithm II includes checking whether the bottomhole pressure is higher than the desired pressure gradient (124). If the answer to step 124 is no, Algorithm II terminates (125). If the answer to step 124 is yes, Algorithm II sends a command to actuate and increase flow restriction until desired pressure is achieved or the flow restriction has reached the maximum open position (126). Algorithm II checks whether the desired pressure gradient has been achieved with some tolerance (128). If the answer to step 128 is yes, Algorithm II advises that activator was needed (130) and terminates (132). If the answer to step 128 is no, restrictors along the drill string are used to further adjust the pressure (134). Algorithm II checks again whether the desired pressure gradient has been achieved with some tolerance (136). If the answer to step 136 is yes, Algorithm II repeats step 130 and terminates at 132. If the answer to step 136 is no, Algorithm II raises an alert that gradient needs reduced mud flow or mud weight (138) and terminates (140).

The downhole characteristics identification, analysis, and control techniques disclosed herein allow one to monitor and adjust downhole conditions while drilling, in real time and at desired points along the drill string. For example, a drill string equipped with variable annular flow area controller subs 70 (See FIG. 6) may be operated with one or more variable restrictors 72 extended at different points/depths along the string such that fluid pressure/flow along selected regions in the borehole can be set or maintained as desired. For example, pressure, flow, temperature, caliper, and other desired data is obtained by the distributed sensors 40 on the string and fed to surface or other points along the string via the network 46. Similarly, internal mud pressure/flow along the string 12 can be adjusted as desired with aspects including the internal variable restrictors 74 as disclosed herein.

Figure 10A:
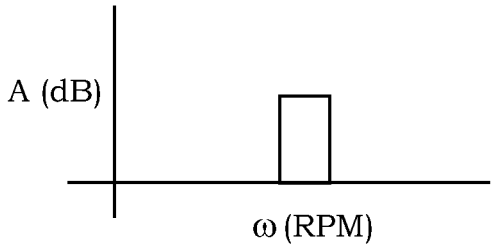
FIGS. 10A-10C illustrate plots of differential measurements in accordance with aspects of the invention.
Figure 10B:
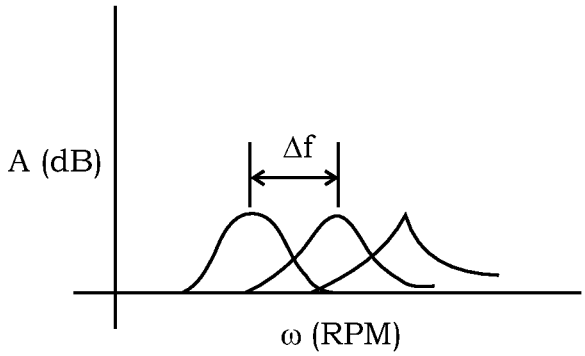
Figure 10C:
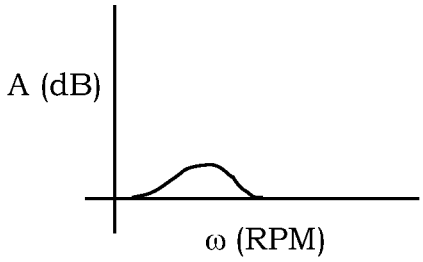

Other aspects of the invention provide for drill string dynamics identification, analysis, and stabilization techniques. In one such aspect, the distributed sensors 40 along the drill string 12 allow one to perform a frequency analysis of differential measurements. FIGS. 10A-10C plot drill string dynamics distributions along a tubular drill string 12. As known in the art, various sensors 40 (e.g., inclinometers, magnetometers, accelerometers, gravimeters, etc.) may be used downhole to determine the dynamic system properties of a drill string. Aspects of the invention can be implemented to provide amplitude distribution measurements as inputs throughout the network 46, the frequency separation of peaks, and sway of dominant frequency for noise can also be obtained. These measurements provide an advantage in the identification of downhole conditions like stick and slip, whirl and changing harmonics/resonant frequencies of a system with changing environment and drill string form, especially in relation to sensors 40 along the string which are adjacent to each other.

An aspect of the invention provides analysis carried out in a process wherein the inputs are first recognized (e.g., RPM (rotational speed), flow rate, weight on bit (WOB)), as shown in FIG. 10A. A represents amplitude in FIGS. 10A-10C. The various components of drill string dynamics properties are then plotted and visualized in the frequency domain. FIG. 10B shows a moment in time (snapshot) of the inputs. Analysis is performed to establish a relationship between the inputs and the frequency characteristics of the measurements. The change in surface inputs will affect the behavior of the different frequency 'peaks', as plotted in FIG. 10B. In FIG. 10B, Δf represents separation of peaks. Amplitude yields an indication of energy loss at a point in the string. Sway indicates the change in speed downhole, when sway is different amongst peaks, this is cumulative torque stick and slip. The separation between the peaks denotes the difference in rotational speed at points of measurement. Stabilization is achieved by fast feedback changes of surface parameters until the maximum possible energy is spent at the bit, rather than along the string (peaks driven to their minimum size), as illustrated in FIG. 10C. Aspects of the invention may be configured with self-learning (artificial intelligence) software as known in the art. Such implementations could entail a downhole learning process. These measurements provide a way to identify drill string harmonics, energy accumulation/release along the string, and allow one to apply stabilization/compensation techniques.

Figure 11A:
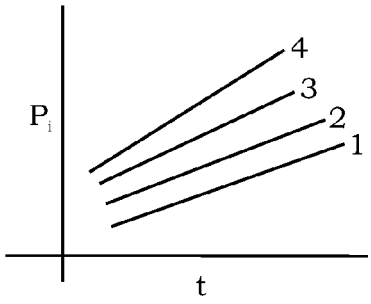
FIG. 11A-11E illustrate plots of frequency measurements in accordance with aspects of the invention.
Figure 11B:
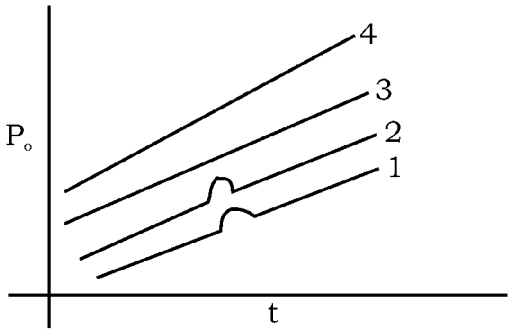
Figure 11C:
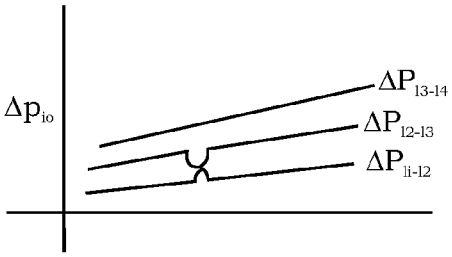
Figure 11D:
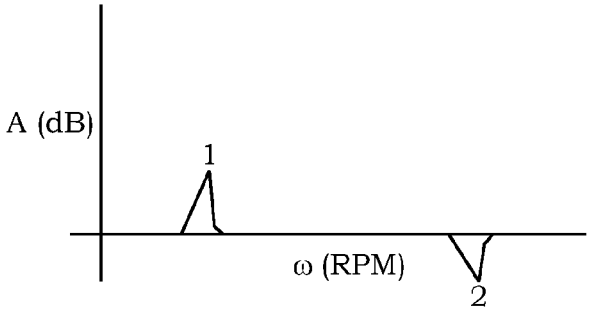
Figure 11E:
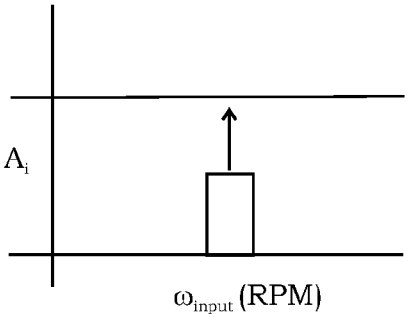

Another aspect of the invention entails frequency analysis on differential pressure measurements from inside and outside the pipe 12, which can be obtained with the distributed sensors 40. FIGS. 1A-11E shows an aspect of the invention that provides analysis in a process grouping events in frequencies and amplitudes to aid in identification and diagnostics. FIG. 11A shows a plot of internal pressure versus time for a plurality of sensor measurements, where node or link 4 is lower in the borehole relative to the position of link 1. FIG. 11B shows a plot of external pressure versus time for a plurality of sensor measurements, where link 4 is lower in the borehole relative to the position of link 1. The objective is to find behavioral events in the drill string that affect the ideal conditions of pressure distribution inside/outside the string. This is achieved by transforming the difference in measurements (FIG. 11C) from one sensor to its neighbor sensor onto the frequency domain, as shown in FIG. 11D. The frequency plots determine the nature of the dynamics effect by its amplitude, sway, and duration. A perfectly homogeneous system would not present any peaks. This objective is achieved by changing input parameters (shown in FIG. 11E) or via other along-string self stabilization methods. Once a mode of destructive dynamics is identified, stabilization/compensation techniques can be applied.

Figure 12A:
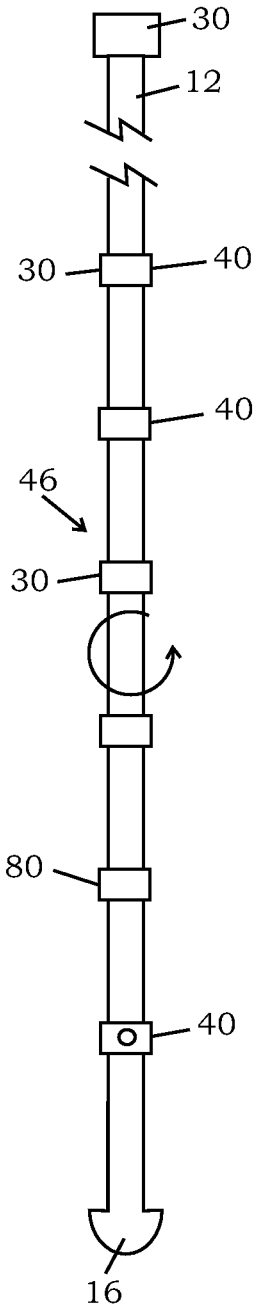
FIG. 12A is a schematic of a drilling system with a counter-weight system in accordance with aspects of the invention.

Aspects of the invention may comprise drill string 12 stabilization/compensation systems to address undesired dynamic conditions. As known in the art, vibrations in a rotating mass can be counteracted upon by the application of weights. In a similar fashion, aspects of the invention can be implemented with a multipoint mass shift system. FIG. 12A shows a drill string 12 equipped with a plurality of sensors 40, mounted on nodes 30 and/or on tools and pipes along the string. The aspect in FIG. 12A is also configured with subs entailing rotating weights 80 distributed along the string 12.

Figure 12B:
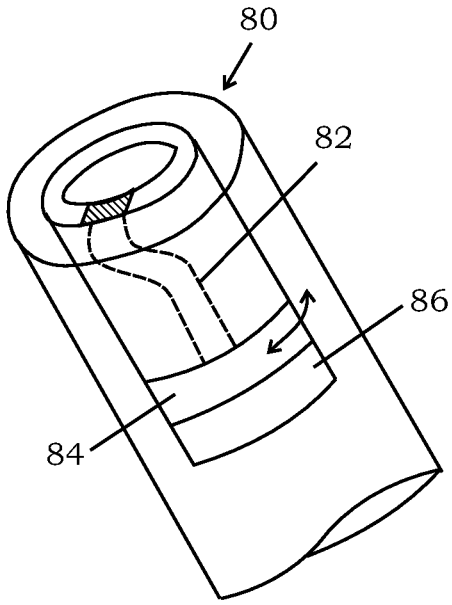
FIG. 12B is a schematic of a rotating weight device in accordance with aspects of the invention.

FIG. 12B is a blow up of a rotating weight 80 device. The rotating weight 80 device includes a shifting mass 82, a driving mechanism 84, and appropriate electronics 86. Input from the sensor(s) 40 is used to identify movement of the string (12 in FIG. 12A), indicating where the string is moving to in average direction of impact against the borehole wall. The electronics 86 actuates the driving mechanism 84 to activate the eccentric mass 82 to counteract destructive harmonics. In one aspect, the mass 82 is configured to rotate (synchronized with or with respect to string 12 rotation) until activated. The driving mechanism 84 can be configured to stop or "brake" the rotating mass 82 for x milliseconds at timed intervals to counteract string movement leading to destructive impact. Conventional components and electronics may be used to implement embodiments of the invention with rotating weight 80 devices. Aspects may be configured with more than one driving mechanism 84 (e.g., above-below the mass 82). Other aspects may be configured with turbine, electromagnetic, hydrodynamic or other types of counter-weight devices (not shown). The rotating weight device 80 is preferably disposed internal to the pipe sub. However, aspects may comprise devices mounted on the pipe exterior or embedded within the pipe walls (not shown). The string 12 in signal communication along the network 46 allows one to monitor string performance at surface in real-time and to take appropriate action as desired. Automatic and autonomous stabilization may be implemented by appropriate programming of system processors in the string 12, at surface, or in combination.

Advantages provided by the disclosed techniques include, without limitation, the acquisition of real-time distributed downhole measurements, drill string dynamics analysis, manual/automated adjustment of downhole pressure/flow conditions, manual/automated compensation/stabilization of destructive dynamics, implementation of automatic and autonomous drill string operations, real-time wellbore fluid density analysis/adjustment for improved dual-gradient drilling, etc. It will be appreciated by those skilled in the art that the techniques disclosed herein can be fully automated/autonomous via software configured with algorithms as described herein. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a magnetic tape; a read-only memory chip (ROM); and other forms of the kind well-known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the invention may also be configured to perform the described computing/automation functions downhole (via appropriate hardware/software implemented in the network/string), at surface, in combination, and/or remotely via wireless links tied to the network 46.

While the present disclosure describes specific aspects of the invention, numerous modifications and variations will become apparent to those skilled in the art after studying the disclosure, including use of equivalent functional and/or structural substitutes for elements described herein. For example, aspects of the invention can also be implemented for operation in combination with other known telemetry systems (e.g., mud pulse, fiber-optics, wireline systems, etc.). The disclosed techniques are not limited to any particular type of conveyance means or subsurface operation. For example, aspects of the invention are highly suitable for operations such as LWD/MWD, logging while tripping, marine operations, etc. All such similar variations apparent to those skilled in the art are deemed to be within the scope of the invention as defined by the appended claims.

What is claimed is:

1. A method of monitoring downhole conditions in a borehole penetrating a subsurface formation, comprising:

disposing a string of connected tubulars in the borehole, the string of tubulars forming a downhole electromagnetic network that provides an electromagnetic signal path between a plurality of sensors in the string of connected tubulars;

receiving sensor data through the downhole electromagnetic network from a first sensor of the plurality of sensors;

receiving sensor data through the downhole electromagnetic network from a second sensor of the plurality of sensors axially spaced apart in the string of connected tubular from the first sensor;

receiving pressure data from the first and second sensors, wherein the pressure data includes pressure measurements both internal to and external of the string of tubulars;

generating a pressure gradient curve using the internal and external pressure measurements; and controlling a downhole condition or a downhole parameter based on the pressure gradient curve.

2. The method of claim 1, wherein generating the pressure gradient curve comprises updating an existing pressure gradient curve using the internal and external pressure measurements.

3. The method of claim 1, further comprising:

comparing the generated pressure gradient curve with a desired pressure gradient curve; and identifying a difference between the generated pressure gradient curve and the desired pressure gradient curve.

4. The method of claim 3, wherein controlling the downhole condition or the downhole parameter comprises adjusting the downhole condition or the downhole parameter if the difference exceeds a set tolerance.

5. The method of claim 4, wherein adjusting the downhole condition or the downhole parameter comprises adjusting a pressure distribution along the borehole to alter an apparent equivalent circulating density.

6. The method of claim 4, wherein adjusting the downhole condition or the downhole parameter comprises one of (i) activating and controlling one or more variable flow restrictors to restrict flow in an annulus between the borehole and the string of tubulars if the pressure at the bottom of the borehole is smaller than a target bottom pressure and (ii) activating and controlling one or more variable flow restrictors to restrict flow inside a bore of the string of tubulars if the pressure at the bottom of the borehole is greater than a target bottom pressure.

7. The method of claim 4, wherein adjusting the downhole condition or the downhole parameter comprises adjusting an annular flow area in a controller sub.

8. The method of claim 7, wherein adjusting the annular flow area includes extending at least one extendable area restrictor into the annular flow area to restrict flow or retracting the at least one extendable area restrictor to leave at least one fixed area restrictor and increase the flow area.

9. A method of monitoring downhole conditions in a borehole penetrating a subsurface formation, comprising:

disposing a tubular string in the borehole, the tubular string including a plurality of sensors and an electromagnetic signal path connecting the plurality of sensors to form a downhole electromagnetic network;

receiving pressure data from the multiple sensors, wherein the pressure data includes pressure measurements both internal to and external of the string of tubulars;

generating a pressure gradient curve using the internal and external pressure measurements;

comparing the generated pressure gradient curve with a desired pressure gradient curve;

identifying a difference between the generated pressure gradient curve and the desired pressure gradient curve; and adjusting a downhole condition or a downhole parameter if the difference exceeds a set tolerance.

10. A system for monitoring downhole conditions in a borehole penetrating a subsurface formation, comprising:

a string of connected tubulars in the borehole, the string of tubulars forming a downhole electromagnetic network that provides an electromagnetic signal path between a plurality of sensors in the string of connected tubulars; and one or more processors configured to:

receive sensor data through the downhole electromagnetic network from a first sensor of the plurality of sensors;

receive sensor data through the downhole electromagnetic network from a second sensor of the plurality of sensors axially spaced apart in the string of connected tubular from the first sensor;

receive pressure data from the first and second sensors, wherein the pressure data includes pressure measurements both internal to and external of the string of tubulars;

generate a pressure gradient curve using the internal and external pressure measurements;

and control a downhole condition or a downhole parameter based on the pressure gradient curve.

11. The system of claim 10, wherein the one or more processors is further configured to update an existing pressure gradient curve using the internal and external pressure measurements.

12. A system for monitoring downhole conditions in a borehole penetrating a subsurface formation, comprising:

a string of connected tubulars in the borehole, the string of tubulars forming a downhole electromagnetic network that provides an electromagnetic signal path between a plurality of sensors in the string of connected tubulars; and one or more processors configured to:

receive sensor data through the downhole electromagnetic network from a first sensor of the plurality of sensors;

receive sensor data through the downhole electromagnetic network from a second sensor of the plurality of sensors axially spaced apart in the string of connected tubular from the first sensor;

receive pressure data from the first and second sensors, wherein the pressure data includes pressure measurements both internal to and external of the string of tubulars;

generate a pressure gradient curve using the internal and external pressure measurements;

compare the generated pressure gradient curve with a desired pressure gradient curve;

identify a difference between the generated pressure gradient curve and the desired pressure gradient curve; and adjust the downhole condition or the downhole parameter if the difference exceeds a set tolerance.

13. The system of claim 12, further comprising a variable annular flow area controller sub coupled to the one or more processors.

14. The system of claim 13, wherein the controller sub further comprises at least one fixed area restrictor and at least one extendable area restrictor to extend into and restrict an annular flow area.

* * * * *